US006588249B1

(12) United States Patent
Milazzo

(10) Patent No.: US 6,588,249 B1
(45) Date of Patent: Jul. 8, 2003

(54) VEHICLE METAL PULLING APPARATUS

(76) Inventor: Paul Milazzo, 5601 Georgia Dr., Bakersfield, CA (US) 93308

( * ) Notice: Subject to any disclaimer, the term of this patent is extended or adjusted under 35 U.S.C. 154(b) by 0 days.

(21) Appl. No.: 10/050,878

(22) Filed: Jan. 18, 2002

(51) Int. Cl.[7] ..... B21J 13/08
(52) U.S. Cl. ..... 72/457; 72/446; 72/705
(58) Field of Search ..... 72/446, 447, 453.01, 72/457, 705

(56) References Cited

U.S. PATENT DOCUMENTS

| | | | | | |
|---|---|---|---|---|---|
| 3,196,726 | A | | 7/1965 | Mordan | 83/523 |
| 3,201,968 | A | * | 8/1965 | Hill | 72/392 |
| 3,817,074 | A | | 6/1974 | Crosthwaite | 72/302 |
| 3,992,919 | A | | 11/1976 | Jarman | 72/447 |
| 4,189,934 | A | | 2/1980 | Kuhn | 72/447 |
| 4,252,008 | A | * | 2/1981 | Dibbens | 72/56 |
| 4,455,859 | A | | 6/1984 | Yamada | 72/447 |
| 4,555,926 | A | * | 12/1985 | Bieli-Moschlin et al. | 72/392 |
| 4,791,802 | A | | 12/1988 | Celette | 72/447 |
| 5,101,654 | A | | 4/1992 | Stevens | 72/447 |
| 5,236,297 | A | * | 8/1993 | Gombos et al. | 414/395 |
| 5,338,015 | A | | 8/1994 | Liegel et al. | 269/71 |
| 5,503,517 | A | * | 4/1996 | Derby | 414/786 |
| 6,059,514 | A | * | 5/2000 | Sanchez | 414/661 |

* cited by examiner

*Primary Examiner*—Ed Tolan
(74) *Attorney, Agent, or Firm*—Dennis W. Beech

(57) ABSTRACT

The vehicle metal pulling apparatus may be mounted on a forklift for use of the hydraulic system to pull metal parts. A cross bar may be attached to the main vertical beam element of the forklift. A push bar may be attached to the cross bar to project forwardly from the forklift for placement against a vehicle to brace the vehicle while pulling on parts. A cable that may be attached at one end to a vehicle part is threaded through a pulley on the cross bar and attached to the forklift vertical lift apparatus. The forklift may then be operated to pull the cable and thereby the part to which attached. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

9 Claims, 2 Drawing Sheets

VEHICLE METAL PULLING APPARATUS

BACKGROUND OF THE INVENTION

This invention relate to pulling of sheet metal parts and other material of vehicles such as automobiles. The apparatus may be used to pull deformed metal resulting from as for example in an automobile accident. The new apparatus may be attached to forklifts to take advantage of an existing mobile hydraulic system.

Systems and apparatus for pulling, bending and otherwise manipulating the parts of a vehicle such as an automobile or truck have been in use for many years. Such methods and apparatus are normally done in a repair facility or shop environment. The vehicle is usually fixed in position in some manner, for example, on a frame puller or anchored to a tie down position. The metal parts of the vehicle can then be hooked or attached to a chain or cable and pulled by use of a lever or hydraulic mechanism. In this manner a damaged vehicle may be repaired or parts salvaged for resale.

Examples of frame pulling apparatus are available in the literature of which U.S. Pat. No. 5,101,654 is an example. In this disclosure, although the apparatus appears to be portable, the machine must be located at a specific point and anchored, tied down or fixed before the apparatus may be used to pull on vehicle parts. The apparatus does not have enough weight or mass to remain in place when being used for pulling. A mobile, portable, simple to use pulling apparatus should allow movement to a wrecked vehicle and pulling of metal parts without the need to anchor the apparatus.

As can be seen, there is a need for a simple, mobile vehicle metal pulling apparatus. Vehicle parts may thereby be quickly evaluated and salvage value determined, for example, testing the engine. Also no cutting may be required which might damage wiring and other valuable parts.

SUMMARY OF THE INVENTION

One object of the present invention is improved portability of an apparatus for use in pulling on vehicle metal parts and other material without the need to fix the apparatus to a structure or to anchor in the ground at the operation site. Another object is use of a forklift for attachment of a cross bar assembly having a push bar for placement against a vehicle and having a pulley through which a chain hooked to vehicle part may be threaded and attached to the forklift vertical lift apparatus.

These and other features, aspects and advantages of the present invention will become better understood with reference to the following drawings, description and claims.

DESCRIPTION OF THE PREFERRED EMBODIMENT

The following detailed description is the best currently contemplated modes for carrying out the invention. The description is not to be taken in a limiting sense, but is made merely for the purpose of illustrating the general principles of the invention.

Figure 1:
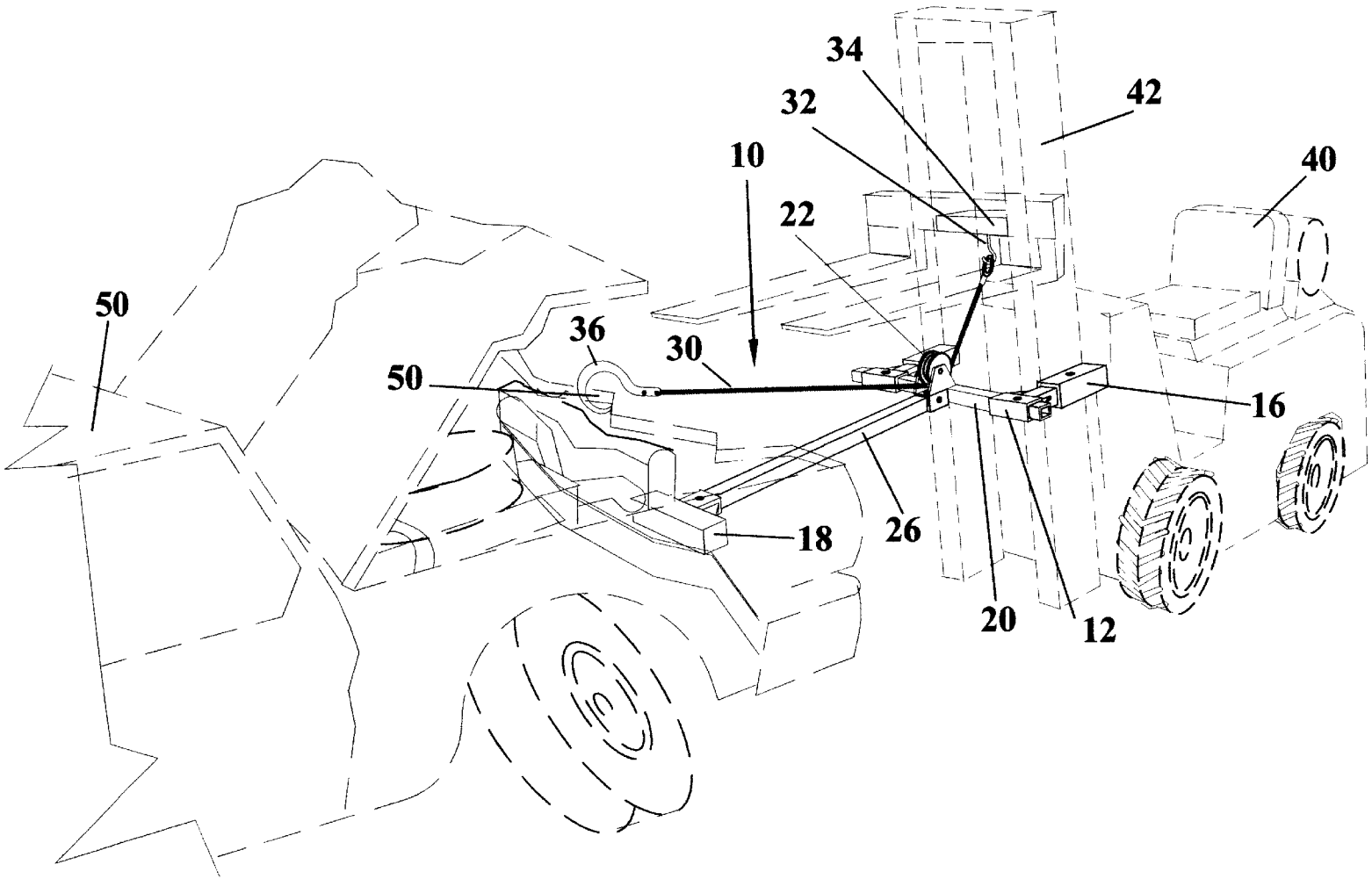
FIG. 1 illustrates a perspective view of an embodiment of the invention.
Figure 2:
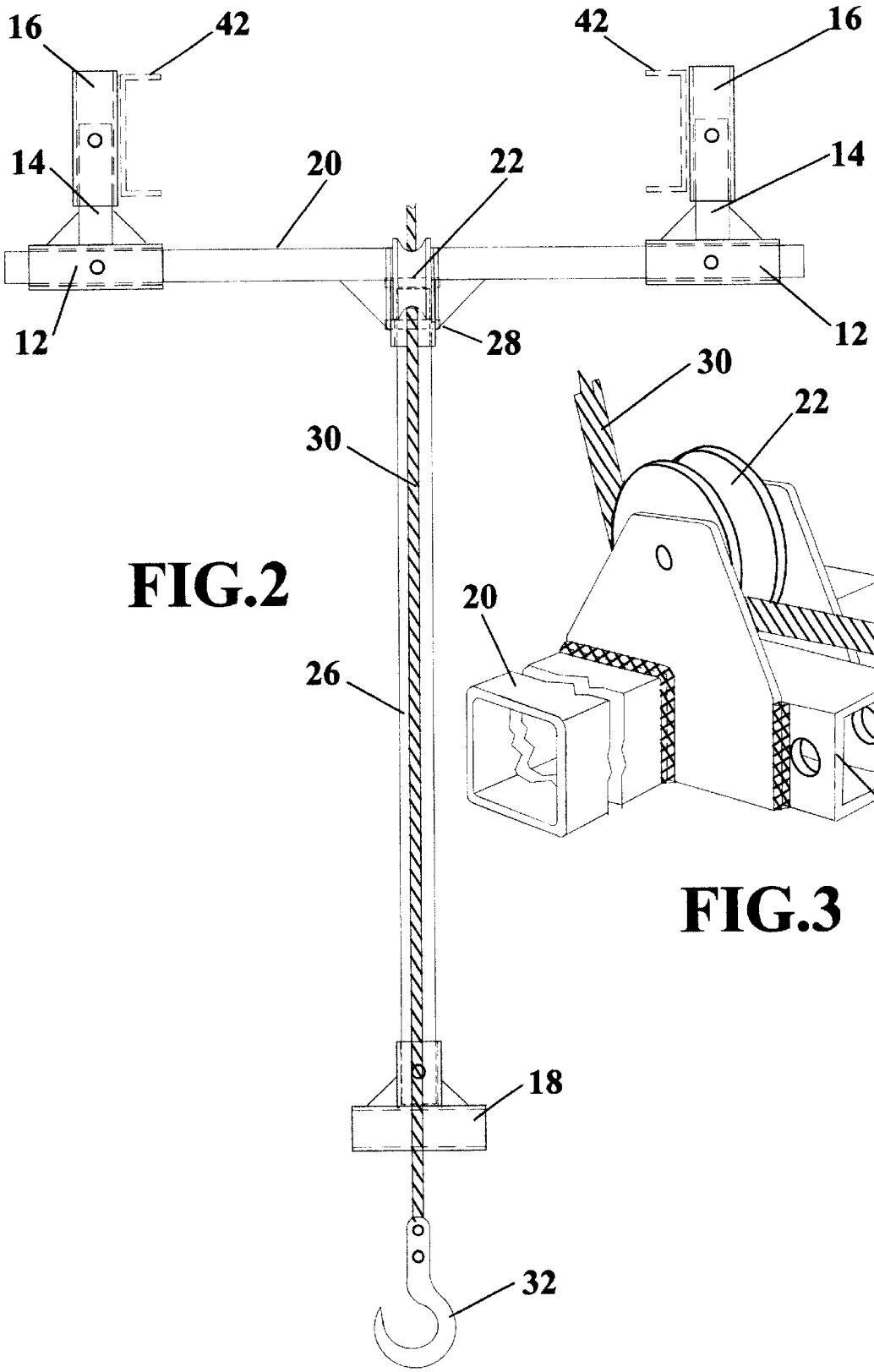
FIG. 2 illustrates a top view of the major elements according to an embodiment of the invention.
Figure 3:
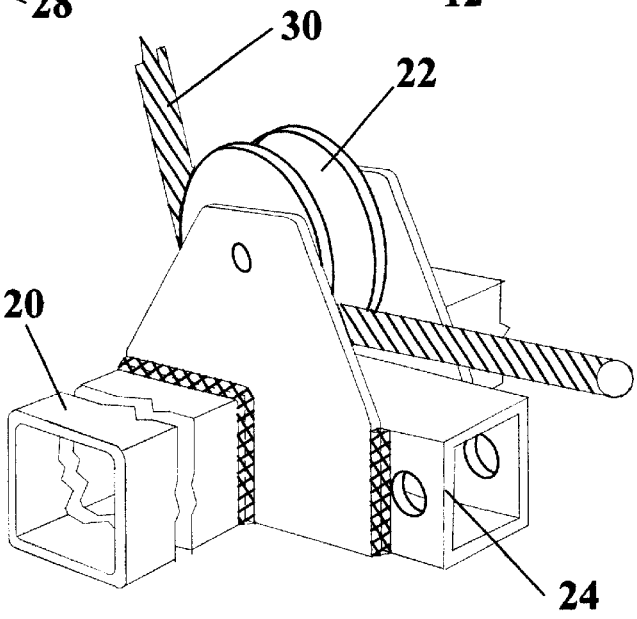
FIG. 3 illustrates a perspective view of the cross bar according to an embodiment of the invention.

Referring to FIGS. 1 through 3, a metal pulling apparatus 10 may be mounted on a forklift 40 and positioned adjacent a vehicle 50 for purposes of pulling metal material 52, for example, sheet metal panels, front end elements, doors and the like. The metal pulling apparatus 10 has two forklift attachment elements 12 with legs 14 that may be inserted into forklift mounts 16. The forklift mounts 16 may be attached to the forklift 40 main vertical beam element 42 by welding, fasteners or the like.

A cross bar 20 may be attached to the forklift attachment element 12 for positioning forward of the forklift 40 vertical lift apparatus 44. The cross bar 20 may have a pulley 22 and an extension fitting 24 attached intermediate the forklift attachment elements 12.

Once the cross bar 20 is mounted on the forklift 40, a push bar 26 of the desired length to separate the forklift 40 from the vehicle 50 during the pulling operation may be inserted into the extension fitting 24 to forwardly project from the forklift 40 and may be attached by for example a locking pin 28. A brace bar 18 may then be attached at the distal end 29 relative to the forklift 40 to be braced against the vehicle 50 to inhibit motion toward the forklift 40.

A chain, cable or the like 30 is then threaded through the pulley 22 and one end may be placed on a hook 32 attached to forklift cross beam 34. The other end of the chain or cable 30 may have a vehicle hook 36, clamp or like device attached for engaging the vehicle 50 metal material 52 for purposes of pulling.

With the cable 30 in place and the vehicle 50 engaged, the forklift 40 hydraulic system may be activated thereby raising the vertical lift apparatus 44. The cable 30 may be pulled through pulley 22 thereby pulling the metal material 52 toward the forklift 40. The brace bar 18 and structure of the apparatus 10 inhibit vehicle 50 movement toward the forklift 40. in this manner damaged metal material 52 may be disengaged from other elements of the vehicle 50.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. An apparatus for pulling metal material and parts of vehicle comprising:

a cross bar mountable to a forklift;

a pulley and a push bar attached to the cross bar at the approximate center thereof wherein the push bar projects forwardly relatively to the forklift;

a cable threaded through the pulley and attached at an end to a fastener on a vertical lift apparatus of the forklift; and a vehicle attachment device attached at a free end of the cable.

2. The apparatus as in claim 1 wherein the cross bar is mounted to the forklift by attachment to a main vertical beam element of the forklift.

3. The apparatus as in claim 1 wherein there is a brace bar attached at a distal end of the push bar.

4. An apparatus for pulling metal material and parts of vehicles comprising:

a cross bar attached to a pair of forklift attachment elements that are mountable to a forklift;

a pulley and an extension fitting attached to the cross bar intermediate the two forklift attachment elements;

a push bar attached to the extension fitting and forwardly extending relative to the forklift;

a chain threaded through the pulley and attached at an end to a fastener on a cross beam of a vertical lift apparatus of the forklift; and a vehicle attachment device at a free end of the chain.

5. The apparatus as in claim 4 wherein the cross bar is mounted on the forklift by inserting a leg of each forklift attachment element in a forklift mount that is attached to a main vertical beam element of the forklift.

6. The apparatus as in claim 4 wherein there is a brace bar attached at a distal end of the push bar.

7. The apparatus as in claim 4 wherein the vehicle attachment device is a vehicle hook.

8. An apparatus for pulling metal material and parts of vehicles comprising:

a cross bar attached to a pair of forklift attachment element that each have a leg insertable into a pair of forklift mounts that are attached to a main vertical beam element of a forklift;

a pulley and an extension fitting attached to the cross bar intermediate the two forklift attachment elements;

a push bar attached to the extension fitting and forwardly extending relative to the forklift;

a brace bar attached at a distal end of the push bar;

a cable threaded through the pulley and attached at an end to a fastener on a cross beam of a vertical lift apparatus of the forklift; and a vehicle hook attached at a free end of the cable.

9. A method for pulling metal material and parts of a vehicle, comprising the steps of:

mounting a cross bar on the two main vertical beam elements of a forklift;

attaching a push bar to the cross bar to project forwardly of the forklift;

threading a chain through a pulley attached to the cross bar and attaching one end of the chain to a fastener on a cross beam of a vertical lift apparatus of the forklift;

attaching a vehicle hook to a free end of the chain and engaging the vehicle hook with a part of the vehicle;

moving the forklift to engage the push bar with an element of the vehicle;

activating a hydraulic system of the forklift to raise the vertical lift apparatus thereby drawing the chain through the pulley to pull on the part of the vehicle.

* * * * *